US005642639A

United States Patent [19]

Codatto

[11] Patent Number: 5,642,639

[45] Date of Patent: Jul. 1, 1997

[54] BLANK HOLDER HAVING VARIABLE ASSEMBLY

[75] Inventor: Antonio Codatto, Lonigo, Italy

[73] Assignee: Sapim Amada S.p.A., Lonigo, Italy

[21] Appl. No.: 503,735

[22] Filed: Jul. 18, 1995

[30] Foreign Application Priority Data

Jul. 27, 1994 [IT] Italy ..... VI94A0120

[51] Int. Cl.[6] ..... B21D 5/04; B21D 11/20

[52] U.S. Cl. ..... 72/319; 72/478; 72/413

[58] Field of Search ..... 72/478, 319, 413

[56] References Cited

U.S. PATENT DOCUMENTS

| | | | |
|---|---|---|---|
| 4,532,792 | 8/1985 | Hongo | 72/319 |
| 4,660,402 | 4/1987 | Hongo | 72/478 |
| 4,722,214 | 2/1988 | Hayashi et al. | 72/319 |
| 4,930,332 | 6/1990 | Hongo | 72/478 |

FOREIGN PATENT DOCUMENTS

| | | | |
|---|---|---|---|
| 60-18228 | 1/1985 | Japan | 72/478 |
| 63-207419 | 8/1988 | Japan | 72/478 |
| 1-154822 | 6/1989 | Japan | 72/478 |
| 5-212446 | 8/1993 | Japan | 72/478 |
| 6-190447 | 7/1994 | Japan | 72/478 |

*Primary Examiner*—David Jones
*Attorney, Agent, or Firm*—Bucknam and Archer

[57] ABSTRACT

A blank holder having variable assembly is used in a folding machine for the production of a sheet panel. It comprises a central element (3), a plurality of additional elements (6), a pair of expander elements (4), two extremity members (7), at least one programmable carriage (15) movable along the blank holder which is operable to modify the length of the blank holder.

9 Claims, 6 Drawing Sheets

BLANK HOLDER HAVING VARIABLE ASSEMBLY

FIELD OF THE INVENTION

The present invention relates to a blank holder, more specifically to a blank holder capable of being utilized in the folding machines which are used for the production of sheet panels starting from flat sheets.

BACKGROUND OF THE INVENTION

The sheet panels having folded borders are used extensively in the construction of electro-domestic articles, boxes, furniture and metallic shelving. The production of these articles is carried out with suitable folding machines the main features of which are a system of blades and a blank holder device by means of which it is possible to produce the desired fold on the flat sheets which are subjected to the action of the folding machine.

It is part of the known technology with respect to folding machines to use a pair of blades opposed one to the other supported by a cutter block in the shape of a "C" which is movable in the vertical direction with respect to the blank holder device. This blank holder, in the case of the production of panels which have the borders folded towards the interior, must be capable of contracting in order to allow the motion of the same panel. In addition, there must be the possibility of varying the extension of the same blank holder in a manner to be able to change rapidly the dimension of the panels which are produced and the profile of the fold of the same panels.

It is also part of the technology of the folding machines to provide for the modification of the length of the blank holder device in a programmed manner. The variation of the length of the base of the blank holder is achieved in the folding machines already known in the art by varying the number of suitable segments of which the blank holder itself is composed. The final regulation of the length of the blank holder is then achieved by substituting the members at the extremities of the blank holder. On the side of the blank holder, the folding machine in addition must provide for the presence of two storehouses which contain a plurality of corresponding symmetrical members at the extremities and also suitable means for their automatic and programmed substitution. The latter may consist for instance of programmer carriages provided with suitable separation systems which are slidable along suitable guides due to the rotation of screws which are as long as said guides and which are moved in two directions by suitable motors.

The motion of the carriages which are used to achieve the substitution of the extremity members must be simultaneous and suitably synchronized with the contraction phase of the same blank holder.

This type of configuration which is used with the folding machines known at present is affected by several functional limitations due to their complexity, limitations which cause mechanical problems which increase the cost of management and upkeep of the same folding machines. The considerable dimensions and consequently the space involved is another problem of the type of folding machines known at the present.

In conclusion, the limitations of the known folding machines are:

1) The presence of two storehouses which contain a corresponding plurality of tools, a fact which causes cost increases and a substantial space requirement;

2) Excessive machinery involved in the system of hooking and unhooking of the members which are used at the extremities, with mechanical problems and increase in the upkeep cost;

3) The necessity of carrying out the change of the extremity members only in a certain vertical position of the blank holder with respect to the front plate of the folding machine which is vertically fixed.

SUMMARY OF THE INVENTION

The above problems are effectively solved by means of the blank holder which is the object of the present invention which is composed of two extremity members which enclose a plurality of additional elements, two expander elements, a central element and a plurality of incremental elements. The latter plurality constitutes one of the main features of the present invention.

In detail, the plurality of the incremental elements consists of a number (n−1) of successive elements, each one having a thickness double the thickness of the preceding element, that is if "p" is the thickness of the thinner incremental element, the successive incremental elements have a thickness which is equal to $2^{(n-1)}\times p$ in which "n" is the ordinal position of the single element, the "n"th element "n" has the same thickness of the additional elements having constant thickness.

The utilization of the plurality of incremental elements with the thickness having quadratic increment, permits to achieve with only the combination of "k" elements a number of assemblies of the blank holder equal to $2^{(k-1)}\Delta p$. This plurality of values which will be referred to hereinbelow as the final regulation and which is obtained by the combination of the incremental elements is to be added to one or more of the additional elements.

By way of example, if the increment $\Delta$ p in the assembly of one blank holder is of 5 mm and the utilization of 4 incremental elements is desired, the thickness of the thinner incremental element will be 5 mm while the successive incremental elements will have a thickness respectively of 10, 20 and 40 mm.

By combination among themselves of the four elements, there are obtained 15 different lengths with an increment $\Delta$ p equal to 5 mm, from 5 mm up to 75 mm. The successive increment of 80 mm is obtained by using the first additional element of 80 mm and the further measurements of the blank holder with $\Delta$ p=5 mm, are obtained using the additional elements of constant thickness exactly from 80 mm.

The plurality of the incremental elements is positioned laterally with respect to the central element thus permitting an asymmetrical assembly of the blank holder with respect to the axis of the same central element and which corresponds also to the axis of symmetry of the support structure of the same blank holder. This possibility of placing laterally the plurality of the incremental elements constitutes an advantage with respect to the known assemblies because as it will be clarified further hereinbelow, it is possible to utilize a number of incremental elements equal to one half minus 1 of the incremental elements which have been used in the symmetrical assemblies and which permits, keeping the time involved in the assembly the same, to utilize a single programmer instead of two. When the folding machine is provided with manipulation means for the sheet being worked, which require that the axis of symmetry of the profile to be folded correspond to the axis of the central element, the assembly of the blank holder will be symmetrical with respect to the axis of the same central element. In this situation, it is necessary to use two pluralities of incremental elements placed laterally with respect to the central element.

This requires that if Δ p is the minimum increment of the total length of the blank holder, the measure of the thickness of the thinner incremental element present in the two pluralities must be equal to Δp/2 and all the successive elements have a thickness which increases in a quadratic manner according to the formula $2^{n-1}\times\Delta P/2$ in which "n" indicates the ordinal position of the element in the plurality.

By way of example, if the assembly of the blank holder has an increment Δ p equal to 5 mm and the additional elements have a thickness of 80 mm, by application of the formulae indicated hereinabove, each one of the two pluralities of incremental elements positioned symmetrically with respect to the central element will be composed of k=5 elements; the thinner incremental element of 2.5 mm followed by the incremental elements of a thickness 5,10,20 and 40 mm.

The minimum assembly of the blank holder will be constituted by the central element, the two expander elements which are placed laterally with respect to the central element and by the two extremity members.

The assembly of measures greater with respect to the minimum measure are obtained by utilizing in addition to the elements mentioned hereinabove the incremental elements for measures up to the maximum of the thickness of the pluralities of the same elements and have still greater measures by placing near the preceding elements one or more spacer elements having constant thickness.

The second novel feature of the present invention resides in the fact that all the elements which have the function of composing the different measures of assembly of the blank holder and which constitute the equipment of the folding machine (the central element, the two spacer elements, the incremental elements, the additional elements and the two extremity members) are positioned linearly in the lower part of the plate which supports the same blank holder and are connected to it.

This position causes the elements which constitute the assembly of the blank holder to be disposed one adjacent to the other and be enclosed between the two extremity members while the additional elements which are not used are placed externally with respect to the extremity members and the incremental elements which are not used are disposed in an area of a storehouse situated in one or both the extremities of the support of the blank holder (depending whether one deals with the asymmetric or symmetrical assembly and in line with the same blank holder.

This storehouse which constitutes another feature of the present invention has the novelty of having a dimension which is reduced because it must contain at the most the "k" elements which constitute the entire plurality of the incremental elements.

The assembly of a specific length of the blank holder, in addition to the vertical movement of the central element and the symmetrical horizontal movement of the two expander elements which are placed close to it (operations which are repeated after each action of folding perpendicular to at least another previous action of folding in which the vertical space of the folding is towards the interior of the panel in order to allow the extraction of the material which has been worked as it will be described hereinbelow) requires the positioning of a plurality of incremental elements for the final regulation of a plurality of additional elements and the two extremity members which enclose the blank holder.

This positioning step is carried out by means of one or more programmer carriages respectively in the case of an asymmetric and symmetrical assembly, the carriages being placed in front of the elements to be moved and slidable linearly through suitable means actuated by a numerical control.

The programmer carriage contains the splitting-packaging group and the group which must engage the extremity members and the incremental elements. The splitting-packaging group constituted by a device which is capable of being lengthened and being shortened and which is provided with a tool capable of being restrained with the additional element has the dual function of determining the reciprocal spreading apart of the additional elements (splitting step) in order to allow the insertion of the extremity members or the positioning of the additional elements which are not used on the exterior of the blank holder being assembled and proceed therefore to the packaging of the totality of the additional elements and the incremental elements which constitute the assembly of the blank holder.

The group which engages the extremity members which is provided with a hooking tool which is capable of being lengthened and being shortened serves the dual function of removing or inserting the incremental elements in the incremental pluralities of the blank holder by removing them or depositing them in the lateral storehouse and also has the function of modifying the position of the two extremity members. This latter function is carried out by an unhooking action and extraction of the same supporting elements of the blank holder followed by a translation and by the subsequent reinsertion and hooking of the same elements to the same body in the position required for the new assembly.

The movement of the programmer carriage and the two groups which are contained in it is regulated by means of an electronic circuit which, on the basis of the length of the blank holder being assembled, chooses the most favorable combination of the elements, determines the relative position in the interior of the blank holder and transmits orders to the programmer carriage to carry out the operation of assembly of the new blank holder, that is the motion by the sliding of the additional elements, the removal or the deposit of the incremental elements in a storehouse and finally the positioning of the extremity members.

Constructively the blank holder is assembled in such a manner that its length during the work phase results equal to the length of the corner which must be folded. Therefore during the production of panels which have the borders folded towards the interior and in view of the fact that it is necessary to use extremity members provided with a flattened foot which protrudes laterally in order to be inserted into the lateral borders of the sheet which have already been folded, it is required that the blank holder itself be capable of modifying its lateral extension, that is it must have the possibility of expanding and contracting laterally after the first and the second side have been folded in order to allow the extremities mentioned hereinabove to introduce themselves under the borders and then to be extracted from the borders, and therefore to give the possibility to the entire blank holder to raise and to allow the extraction of the article already worked.

The contraction of the blank holder is obtained by moving vertically the central element by means of a fluid-dynamic cylinder which is connected with the support of the blank holder so that the space which remains free is occupied by the two expander members which are placed laterally. The latter becoming closer to one another allow the contraction of the two lateral packages up to the extremity of a quantity equal to the thickness of the raised central element.

In order to obtain a contraction of the blank holder such as to allow the blank holder to raise itself above the boxed panel, it is necessary that the thickness of the central element be slightly greater with respect to the vertical space towards the interior of the area of the folds which have been carried out in the perpendicular sides previously carried out.

The two expander members have a vertical body provided with a horizontal arm which slides within suitable guides, the guides being formed on the lower base of the support of the blank holder, this arm having the purpose of supporting the expander element during the phases of contraction and expansion of the blank holder.

The linear movement of the expander elements is obtained with elastic means such as springs or fluid -dynamic cylinders which are integral with the support of the blank holder.

The production of panels in the shape of a box and particularly the production of panels which have the border folded towards the exterior requires the creation of spaces which are free on the sides of the extremity members. In order to obtain this space, each extremity member is provided with an elastic device which is protruding laterally from the same member and which ensures that during the parcelling step which has the function of eliminating the empty spaces which have been formed between one element and another of the blank holder after the movement of the additional elements, the addition or the removal of the incremental elements and the positioning of the extremity members, there is formed a niche capable of containing the borders of the panel which have been previously folded.

From what has been described hereinabove, it results that operatively the step of folding the panel which is carried out with the blank holder of the present invention is similar to the steps of the known folding machines but the novelty resides in the step of assembly of the blank holder itself which is characterized in the use for the final regulation of the length of the blank holder of a number "k" of incremental elements with a thickness which increases in quadratic manner and additional elements. The incremental elements are placed on at least one side of the expander elements and the additional elements have constant thickness. Both these elements are enclosed within the two extremity members which also have constant dimension. The novelty is also due to the fact that the area of storage is capable of containing at the most the "k" elements and is aligned and is integral with the blank holder in such a manner as not to require further motion and/or additional mechanisms for the deposit and for the removal of the same incremental elements.

BRIEF DESCRIPTION OF THE DRAWINGS

These and other characteristics of the invention will be further illustrated by means of the description of two particular embodiments which are provided by way of illustration of examples and which are not intended to be limitative, by reference to the attached drawings of which;

As shown in FIG. 1, the blank holder (1) of the asymmetric assembly type is anchored to support (2) which moves vertically. The blank holder (1) comprises a central element (3), two expander members (4), a plurality of incremental elements (5), a plurality of additional elements (6) and the two extremity members (7). All these elements and the two extremity members are disposed one adjacent to the other and they are connected to the support (2).

Figure 1:
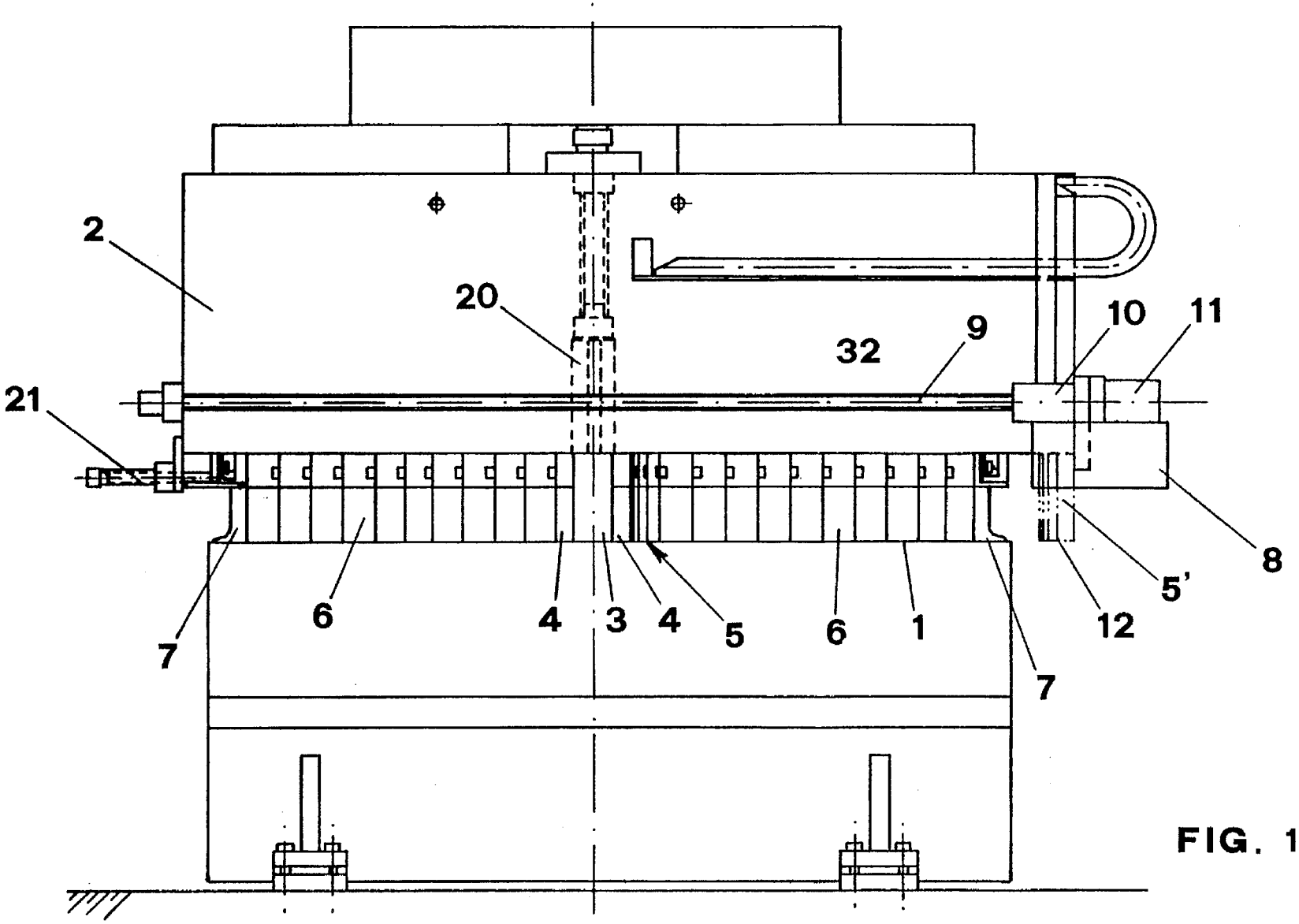
FIG. 1 shows a front vertical view of the folding machine with the assembly of the blank holder of the asymmetric type.

The programmer carriage (8) slides in front of the blank holder (1) by means of screw (9) which is connected to the slider (10) which supports the same carriage and this screw is rotated in one direction or the other by means of motor (11).

The storehouse (12) is located laterally with respect to the blank holder (1) and in line with the same and is also connected to the support (2). The storehouse contains the incremental elements (5') which are not utilized to form the plurality of the incremental elements (5) which are necessary for the assembly of the same blank holder.

Figure 2:
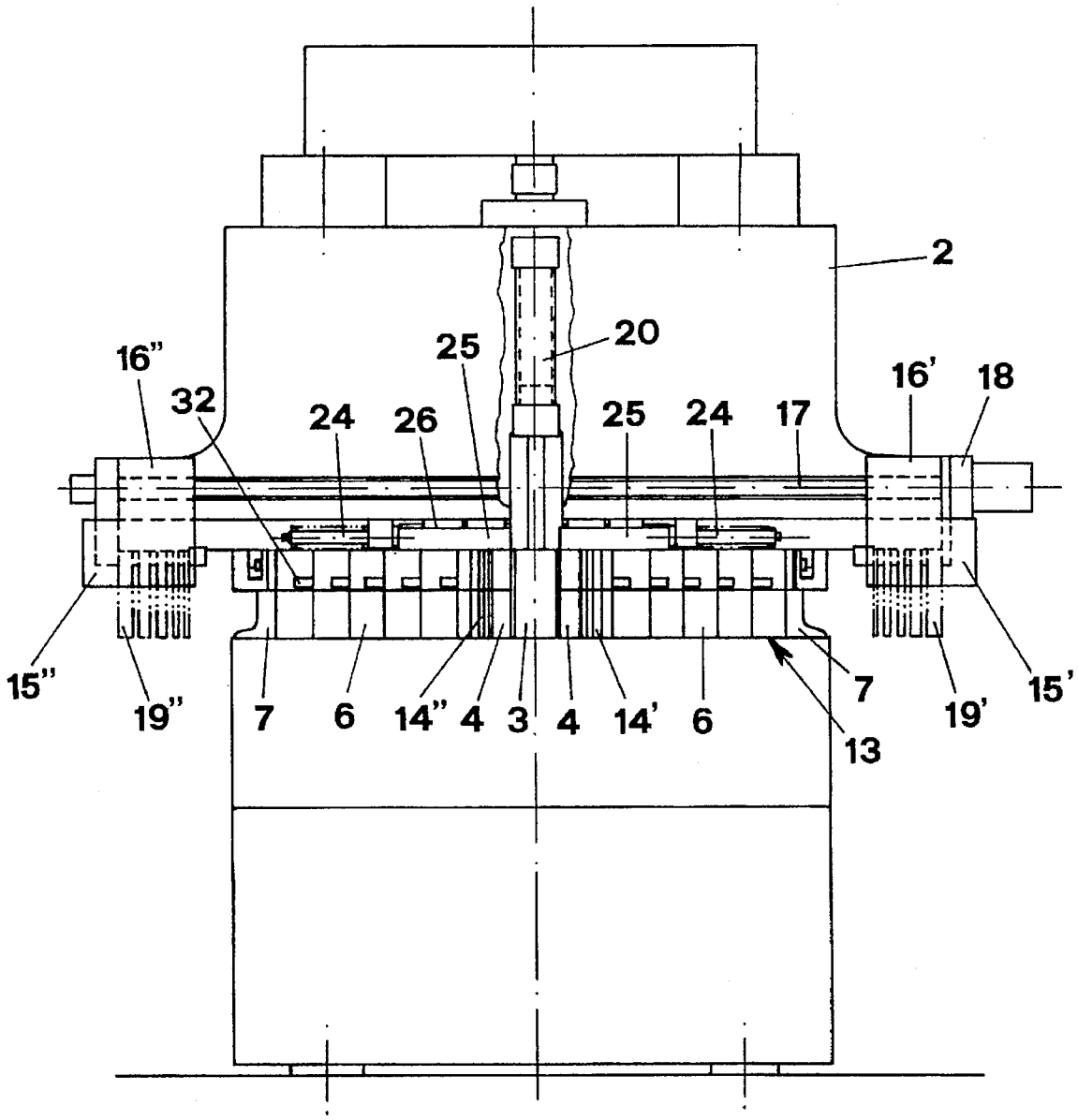
FIG. 2 is a front vertical view of a folding machine with an assembly of the blank holder of the symmetrical type.

FIG. 2 shows a blank holder (13) with assembly of the symmetrical type in which there are two pluralities of incremental elements 14' and 14" which are placed in a symmetrical manner with respect to the central element (3).

Two programmer carriages 15' and 15" are located laterally with respect to the double plurality of incremental elements and they are supported by the respective sliders 16' and 16". These sliders are connected to a bar (17) which is threaded in such a manner that when it is rotated by means of a motor (18), the sliders are moved symmetrically with respect to the center of the blank holder (13).

Another consequence of the presence of the double series of incremental elements is the presence of two areas of storage 19' and 19" which are placed laterally and which are aligned with the blank holder (13).

The central element (3) translates vertically raising itself above the blank holder due to the action of the fluid-dynamic cylinder (20) which is connected to the support (2) of the blank holder. The vertical motion of the central element (3) allows the two expander elements (4) which are laterally located, to translate toward the center in such a manner that, when they are placed closer one to the other, they occupy the entire space left free by the same element and allow simultaneously the rearward motion of the two lateral packages constituted by the incremental elements (5 and 14), the additional elements (6) comprised between the extremity member (7) and the same expander element.

This action of contraction of the blank holder which allows the withdrawal of the blank holder from the panel which has already been worked, is carried out in the blank holder (1) which is of the asymmetric assembly type by means of the action generated by the programmer carriage (8) and by the fluid-dynamic cylinder (21) while in the blank holder of the symmetrical type of assembly (13) is achieved due to the contemporaneous and opposite action of the two programmer carriages 15' and 15".

The subsequent action of expansion of the blank holder, that is the motion toward the exterior of the two packages of the elements, is carried out through the action of the two expander elements (4) which move away one from the other in order to allow the descent and the insertion between them of the central element (3).

Figure 4:
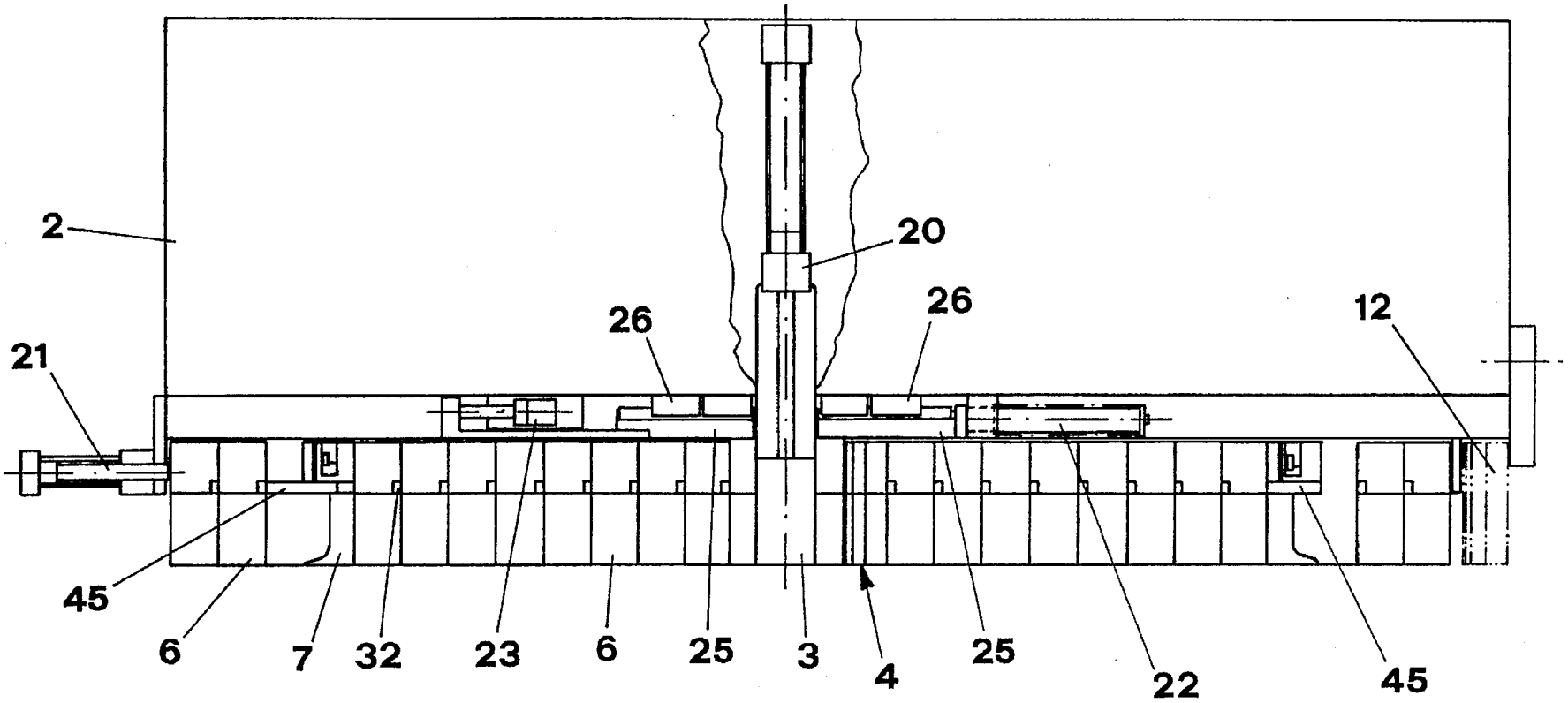
FIG. 4 illustrates on an enlarged scale the two sides of which the blank holder of the asymmetric type is schematically composed.
Figure 8:
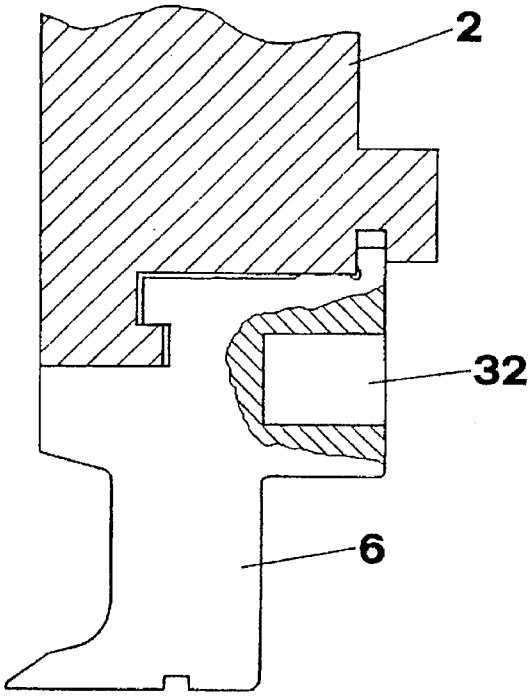
FIG. 8 is a lateral view of the additional element.
Figure 7:
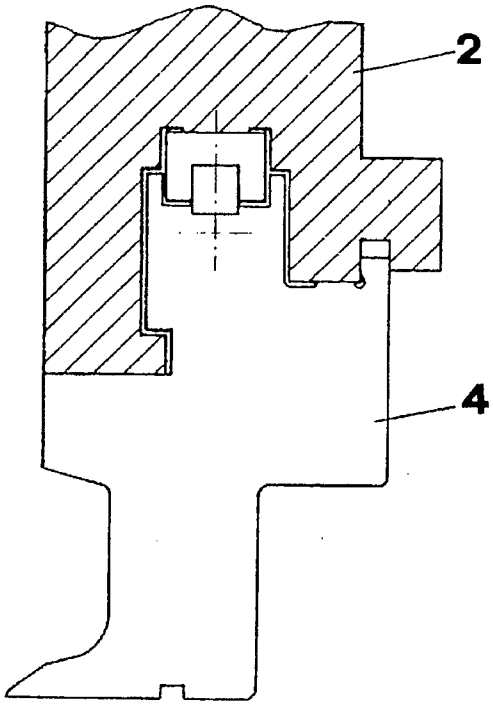
FIG. 7 is a lateral view of the expander element.

As shown in FIG. 4, the two expander elements are moved in their action of reciprocally moving away in the case of blank holder (1) which is of the asymmetrical type of assembly by means of an elastic means (22) and fluid-dynamic cylinder (23). On the contrary in the case of the blank holder (13) which is of the symmetrical type of assembly, the motion occurs by means of two elastic means (24) which have opposed action.

These means of motion (22, 23 and 24) are connected to the support plate (2) and act on the horizontal arm (25) which is connected to the expander element and which is held in guide by the rolling tools (26).

Figure 3:
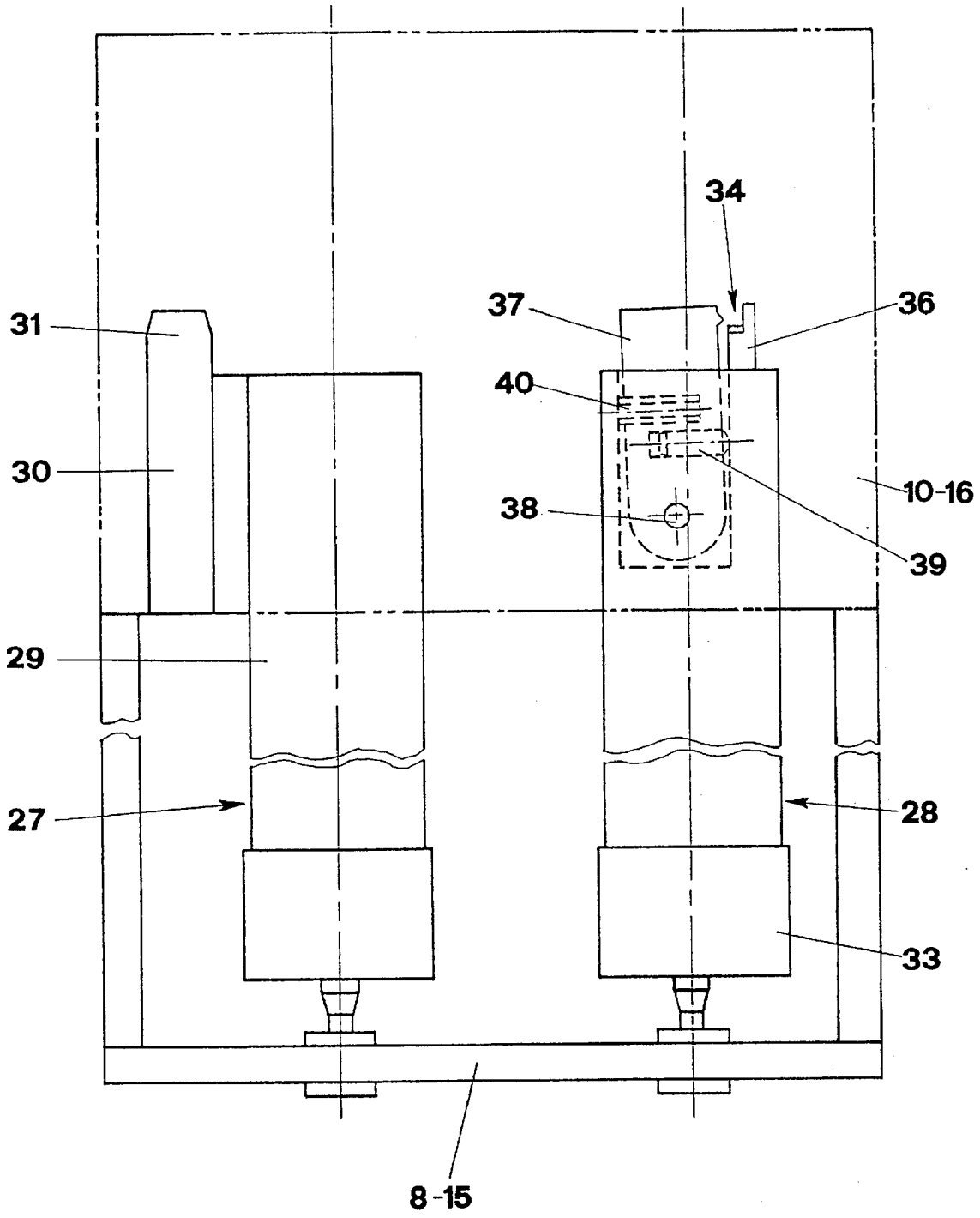
FIG. 3 illustrates a plan view of the programmer carriage which contains the group of engagement of the extremity members and/or the incremental elements and the splitting-packaging group.

FIG. 3 shows that the programmer carriage (8,15) contains the splitting-parcelling group (27) and the group of engagement of the extremity members (28) and/or the incremental elements.

The splitting-parcelling group (27) is constituted by a fluid-dynamic cylinder (29) which is connected to the programmer carriage and is lengthenable towards the operating machine. This fluid-dynamic cylinder (29) is provided with a bar (30) which has the end (31) shaped in such a manner as to penetrate within the recess (32) formed in the body of the additional elements (6) and so that it is also capable of carrying out the steps of moving the latter during the operations of splitting and parcelling which are required for the assembly of the blank holder.

The group of engagement of the extremity members (28) and/or the incremental elements is constituted by a fluid-dynamic cylinder (33) which is connected to the programmer carriage structure and may be lengthened towards the folding machine. This fluid-dynamic cylinder shown in FIG. 1 is provided at the end with a hooking tool (34) capable of engaging with the shaped protrusion (35) which is shown in FIGS. 5 and 6 of which the incremental elements (5 and 14) and the two extremity members (7) are provided.

The hooking tool (34) consists of a fixed part (36) and the lever (37) which has as the fulcrum pin (38). The lever is placed in motion by the opposite action of the fluid-dynamic cylinder (39) which generates the opening of the same hooking and the contrasting spring (40).

Figure 5:
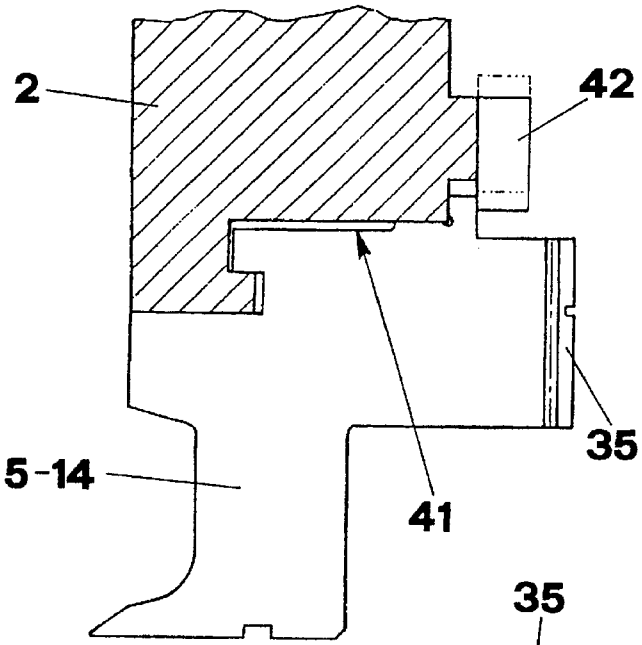
FIG. 5 is a lateral view of the incremental element.
Figure 6:
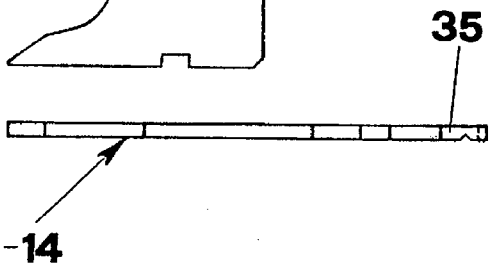
FIG. 6 is a plan top view of the incremental element.

As shown in FIG. 5, the incremental elements (5) and (14) are connected to the support (2) of the blank holder by means of the shaped profile (41) which is restrained. These elements are held in position by the transversal front bar (42) which is raised during the phase of extraction of the incremental element.

FIGS. 9, 10, 11 and 12 show the characteristics of the extremity member (7) and precisely they illustrate the presence of the elastic member (43) and the hooking and unhooking group (44) to the support (2) of the blank holder.

The elastic element (43) is constituted by the angular lever (45) which has pin (46) as the fulcrum, the pin being connected to the body (7).

The two arms of the lever (45) are of different length. The longer arm (47) guarantees the formation of a niche which is disposed laterally with respect to the body (7) while the shorter arm (48) presents an extremity connected to spring (49) which is connected to body (7) and which has the function of maintaining the element (43) in the position previously ensured by the splitting-parcelling group.

The action of hooking of the extremity member (7) to the body (2) is achieved by means of tenon (50) which rests on both bodies (2) and (7) and which is restrained in the upper part by the mortise (41) which is formed on the upper body (2) by means of the action of the springs (52).

For the movement of the extremity member (7) it is necessary to extract the tenon (50) from the mortise (51) and this is achieved by means of the small lever (57) which has as the fulcrum pin (53) of plate (54), the latter being connected with body (7).

Figure 11:
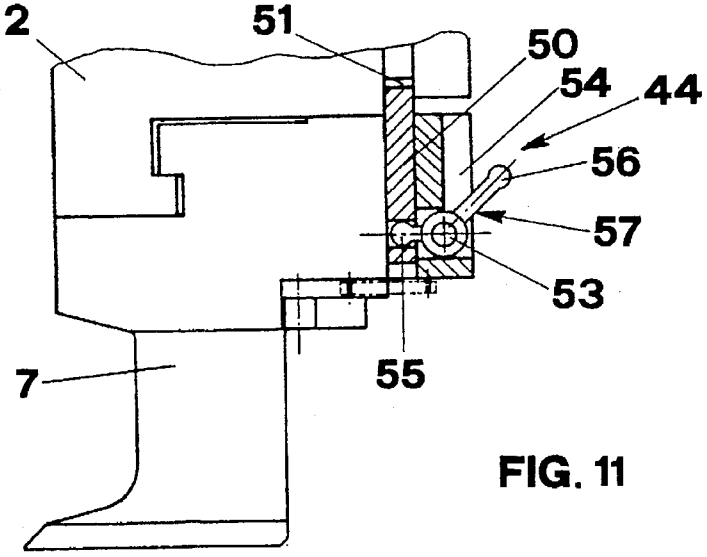
FIG. 11 is a lateral view of the extremity member partially in cross section along line XI—XI of FIG. 9.

The shorter arm (55) of the lever (57) is disposed within tenon (50) while the longer arm (56) during the folding phase protrudes from the plate (54) as shown in FIG. 11.

Figure 12:
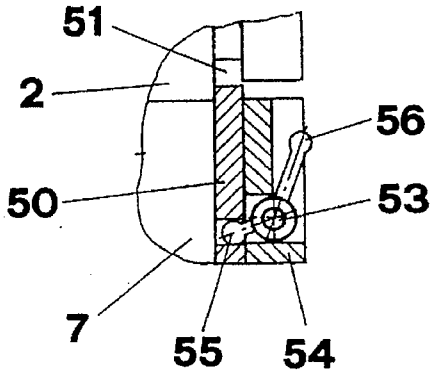
FIG. 12 is a detailed view of the hooking of the extremity member to the support of the blank holder.
Figure 9:
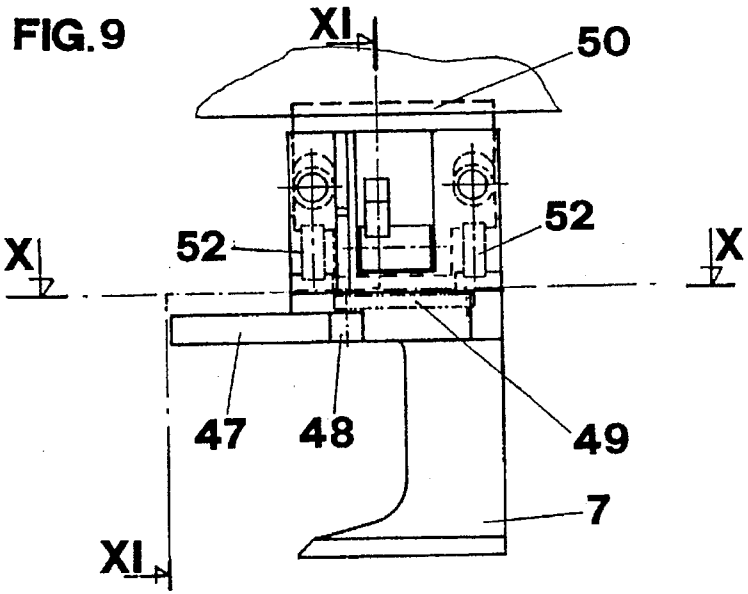
FIG. 9 is a lateral view of the extremity member.
Figure 10:
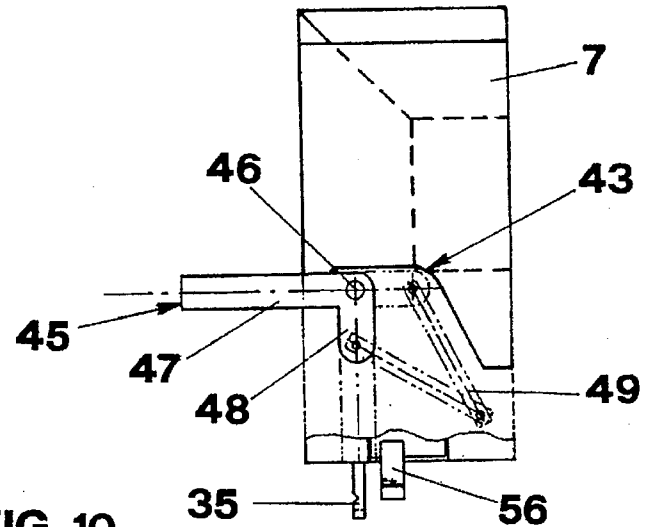
FIG. 10 is a plan view of the extremity member in cross section along the line X/X of FIG. 9.

Advantageously, during the phase of hooking of the protrusion (35), the engaging group (34) pushes towards the interior the protruding arm (56), thus causing the rotation of lever (57) and of the short arm (55), thus causing the lowering of the tenon (50) and the unhooking of the same from the mortise (51) as shown in FIG. 12.

What is claimed is:

1. A blank holder having variable assembly for use in a folding machine for the production of sheet panels, the blank holder having a center and two ends, which comprises a central element (3), placed in the center of said blank holder, a plurality of additional elements (6) having identical thickness, a pair of expander elements (4) located adjacent said central elements, two extremity members (7), located at said ends of said blank holder, at least one programmer carriage (8,15), said carriage being movable along said blank holder and being operable to modify the length of said blank holder, and at least one plurality (n−1) of successive incremental elements (5,14) placed adjacent said expander elements, said additional elements (6) being located adjacent said incremental elements, said incremental elements having a thickness, each of said successive elements having a thickness equal to double the thickness of the incremental preceding element, whereby when the thickness of the thinner incremental element is represented by the value (p), each of said successive incremental elements has a thickness equal to $2^{(n-1)}\times p$, the thickness of said additional elements being equal to double the thickness of the element of greater thickness of said plurality of the incremental elements.

2. The blank holder according to claim 1 which is provided with a support (2) having two lateral extremities (7), at least one storehouse (12,19), some incremental elements (5,14) and some additional elements (6) which are not used, are placed in at least one of said storehouse, said storehouse being connected to one of the lateral extremities (7) of said support (2) of the blank holder, said storehouse being disposed in line with said blank holder, said central element (3), said expander elements (4), said incremental elements (5,14), said additional elements (6) being connected to said support (2).

3. The blank holder according to claim 1 wherein said programmer carriage (8,15) contains a splitting-parcelling group (27) of all the elements which constitute said blank holder, said splitting-parcelling group having an extremity (28), said extremity having an engagement group, and said engagement group at said extremity (28) being capable of placing in motion said incremental elements (5) and said extremity members (7).

4. The blank holder according to claim 1 which comprises a slider (10) supporting said programmer carriage.

5. The blank holder according to claim 1 wherein the thinnest incremental element has a thickness of 5 mm and the successive incremental elements have a thickness of 10, 20 and 40 mm.

6. The blank holder according to claim 1 wherein said central element has a side and said plurality of said incremental elements is positioned on said side.

7. The blank holder according to claim 1 wherein said support is a plate, said plate having a lower part and said central element, said incremental elements, said additional elements and said extremity members are positioned in said lower part.

8. The blank holder according to claim 1 wherein said central elements raises itself vertically, said expander elements are located laterally of said central element and when said central element moves upwardly, said expander elements move toward the center and come closer one to the other.

9. The blank holder according to claim 3, wherein each of said extremity members (7) has a side, a single plurality of incremental elements (5) is placed adjacent to one of the two expander members (4) and a recess is formed on said sides of said extremity members (7), said recess being obtained by elastic means (43), said elastic means being responsive to said engagement group (28) located at said extremity of said splitting-parcelling group.

* * * * *